US006866715B1

(12) United States Patent
Ruschak et al.

(10) Patent No.: US 6,866,715 B1
(45) Date of Patent: Mar. 15, 2005

(54) GRAVURE METHOD AND APPARATUS FOR COATING A LIQUID REACTIVE TO THE ATMOSPHERE

(75) Inventors: Kenneth J. Ruschak, Rochester, NY (US); Rukmini B. Lobo, Rochester, NY (US); Jess A. Anderson, Windsor, CO (US); Richard A. Gilkey, Greeley, CO (US); David A. Wakefield, Canandaigua, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/765,555

(22) Filed: Jan. 27, 2004

(51) Int. Cl.[7] ..... B05C 1/08

(52) U.S. Cl. ..... 118/211; 118/212; 118/244; 118/256; 118/63; 101/157; 101/169

(58) Field of Search ..... 118/211, 212, 118/244, 256, 63; 101/153, 155–157, 169, 170

(56) References Cited

U.S. PATENT DOCUMENTS

| | | | | |
|---|---|---|---|---|
| 2,022,635 A | * 11/1935 | Durham | 101/157 |
| 2,040,961 A | * 5/1936 | Stouch | 101/157 |
| 2,141,978 A | * 12/1938 | Greenhill | 101/157 |
| 3,508,947 A | 4/1970 | Hughes et al. | 117/34 |
| 3,632,374 A | 1/1972 | Greiller | 53/140 |
| 3,936,549 A | 2/1976 | Kohler et al. | 427/428 |
| 4,287,240 A | 9/1981 | O'Connor | 427/402 |
| 4,373,443 A | 2/1983 | Matalia et al. | 101/221 |
| 4,600,608 A | 7/1986 | Ankrett | 427/424 |
| 4,737,486 A | 4/1988 | Henzel | 503/227 |
| 5,114,759 A | 5/1992 | Finnicum et al. | 427/420 |
| 5,681,389 A | 10/1997 | Lobo et al. | 118/212 |
| 5,885,660 A | 3/1999 | Ruschak et al. | 427/420 |
| 5,976,630 A | 11/1999 | Korokeyi et al. | 427/420 |
| 6,228,431 B1 | 5/2001 | Lobo et al. | 427/420 |
| 6,426,119 B1 | 7/2002 | Yapel et al. | 427/335 |
| 6,558,466 B2 | 5/2003 | Hanumanthu et al. | 118/261 |
| 6,582,515 B2 | 6/2003 | Hanumanthu et al. | 118/261 |

* cited by examiner

*Primary Examiner*—Laura Edwards
(74) *Attorney, Agent, or Firm*—Stephen H. Shaw

(57) ABSTRACT

A method and apparatus is disclosed for gravure coating a liquid reactive with the atmosphere onto a web. The gravure apparatus comprises an engraved gravure cylinder, an impression roller backing the web and pressing it onto the gravure cylinder to form a nip, a curtain or jet formation means to wet the surface of the gravure cylinder, and a doctor blade means for wiping excess coating liquid from the surface of the gravure cylinder prior to the nip. A shroud encompassing the gravure cylinder and the curtain or jet formation means creates a first zone between the nip and a partitioning baffle extending from the shroud, a second zone between the partitioning baffle and the doctor blade means, and a third zone between the doctor blade means and the nip. A gas non-reactive with the coating liquid is supplied to each zone by a gas distribution means such that the reaction rate of the coating liquid with the atmosphere is greatly reduced and the curtain or jet is not disrupted. In a particularly preferred embodiment, the gravure apparatus and shroud are enclosed by solid walls and doors.

20 Claims, 6 Drawing Sheets

GRAVURE METHOD AND APPARATUS FOR COATING A LIQUID REACTIVE TO THE ATMOSPHERE

FIELD OF THE INVENTION

The present invention relates generally to methods and apparatus for coating moving webs by the gravure coating method and, more particularly, to an improved gravure coating method and apparatus for the application of a coating liquid that is reactive to the atmosphere.

BACKGROUND OF THE INVENTION

Gravure printing and coating methods are well known means of applying liquids to webs or sheets. U.S. Pat. No. 4,373,443 describes the use of a gravure cylinder to provide ink in newspaper presses. Engraved upon the surface of the gravure cylinder are cells or depressions that are filled to excess with coating liquid. Commonly, a gravure cylinder 10 rotates in a pan 21 holding a constant level of coating liquid that exits via a drainage port 26 for wetting, as shown in FIG. 1 and as taught for example in U.S. Pat. No. 3,936,549. A doctor blade 11, held by a blade holder 22, is typically made of a metal softer than that of the surface of the gravure cylinder 10, and wipes any excess liquid from the surface of the gravure cylinder 10 such that only the engraved areas hold liquid. The gravure cylinder 10 then delivers a precise amount of liquid that exits via a drainage port 26 to a web 18 or other receiving surface upon contact with the engraved areas. The transfer typically occurs in a nip 20 between the gravure cylinder 10 and an impression roller 19 with an elastomeric cover (not shown) that serves as a backing for the web 18. The impression roller 19 presses web 18 against gravure cylinder 10 to create a small area of contact. Alternatively, web 18 can be drawn against gravure cylinder 10 by its tension to create a nip 20.

Dye donor ribbon for thermal printers is manufactured by the gravure coating method. The dye donor ribbon has discrete patches of cyan, magenta, and yellow dyes that produce a color hardcopy when transferred to a receiving paper by a thermal printing head. To make the dye donor ribbon, a subbing layer is first applied to both sides of a plastic web to promote adhesion of subsequent layers. Solutions of dye and binder and registration ink are then applied to the subbed web in discrete patches by a series of gravure coating stations. At another coating station, a slip layer is applied to the back surface of the web to prevent the donor ribbon from sticking to the print head.

The solution of tetra-n-butyl titanate in n-propylacetate is used to make the subbing layer for thermal donor ribbon, as disclosed in U.S. Pat. No. 4,737,486, is an example of a highly reactive and volatile liquid of low viscosity. Tetraalkyl titanates undergo hydrolysis to form an inorganic polymer of high molecular weight and an alcohol biproduct, and so they scavenge surface water. Water vapor in the atmosphere is a source of surface water. According to the General Brochure for DuPont™ Tyzor® organic titanates, the rate of hydrolysis depends upon the size and complexity of the alkyl group, and the presence of alcohols can retard the reaction. Solvents or co-solvents that can be used to control reaction rate include n-butanol, sec-butanol and isopropanol.

Another consideration in choice of solvent is its volatility within the coating zone. Evaporation of the solvent in the coating zone increases the concentration of the solute so that more solute is applied to the web than desired. The solvent lost to evaporation must be replenished to maintain a substantially constant concentration of solute, therefore, representing a cost. On the other hand, a solvent of too low volatility can unacceptably reduce the drying rate of the coating.

If the coating composition undergoes substantial hydrolysis before coating, the functionality of the subbing layer is compromised. In that case, the coating operation must be stopped and the coating liquid replaced. Acceptably slow reaction times cannot always be obtained through choice of solute and solvent. Therefore, in the prior art, shown in FIG. 1, that utilizes a pan feed, the pan is extended to enshroud the gravure cylinder in such cases, and a dry, inert gas such as nitrogen is injected through gas distribution means 28 and 30 to replace the air in contact with the coating liquid as shown in FIG. 1. By reducing or eliminating atmospheric water vapor, the hydrolysis reaction takes place substantially in the coated layer during drying, and long, continuous production runs are possible. The gas distribution means for injecting the inert gas can be any of many such means known in the art, including a die, a conduit with small holes or narrow slits, or a conduit with a side that is perforated or a porous plate.

The use of nitrogen or other inert gases is disclosed in U.S. Pat. No. 4,600,608. When drying takes place in the atmosphere, the concentration of solvent vapor must be maintained below that where combustion can occur. When drying takes place in an inert gas such as nitrogen, however, the concentration of solvent vapor can safely reach saturation. The use of nitrogen or other inert gas that has been saturated with solvent is known in the art in the context of preventing undesired drying in a coating zone, as disclosed in U.S. Pat. No. 6,426,119. For example, drying on the lip of a coating die can produce a buildup of solute and a streaked coating. In prior art literature, nitrogen is also employed to overcome limitations on solvent vapor concentration imposed by explosive mixtures with atmospheric oxygen.

The pan feed application is relatively simple, but has limitations and disadvantages; the most prominent disadvantage is that the liquid entrains the ambient gas at high coating speeds with the result that the gravure cylinder 10 is not completely wetted and the cells are not completely filled such that imperfections and skips in the coating occur. Poorly wetted areas have detrimental effects on the doctor blade 17. The pan feed method supplies liquid to the gravure cylinder far in excess of that needed to fill the engraving. Large amounts of liquid are rejected by the doctor blade 17, resulting in spraying and splashing of the liquid, particularly from the ends of the gravure cylinder 10 causing possible contamination of the ribbon (not shown). Furthermore, the pan feed method is prone to flow lines and flow patterns that produce a non-uniformly coated ribbon.

Other methods of supplying the gravure cylinder with coating liquid are known in the art. These include a freely falling curtain as in U.S. Pat. Nos. 5,681,389 and 6,228,431, and a jet as in section 12*d*.2.3 and FIG. 12*d*.4(*b*) on page 642 of the book, "Liquid Film Coating" (S. F. Kistler and P. M. Schweizer, eds., Chapman & Hall, New York, 1997). A curtain or jet feed method for filling the cells of a gravure cylinder mitigates most of the limitations and disadvantages of the pan feed method. Higher coating speeds are obtainable before the onset of air entrainment. Spraying and splashing are reduced, because a lesser, controlled amount of liquid is applied to the gravure cylinder. Flow lines and patterns associated with a pool are eliminated. However, providing a blanket of inert gas for a curtain or jet is far more difficult than providing a blanket of inert gas for a pan feed apparatus, because of the sensitivity of a thin sheet of liquid to ambient disturbances. The greater flow of gas required promotes turbulence that can easily disrupt, deflect, or even rupture the curtain or jet. As established later in Example 1, a straightforward combination of a die 12 for jet feed with the prior art gravure apparatus of FIG. 1, as shown in FIG. 6, does not adequately control hydrolysis rate at gas supply rates that do not disrupt jet 11. Indeed, in prior art, including U.S. Pat. Nos. 3,508,947, 4,287,240, 5,114,759, and 5,976,630, considerable effort is expended to reduce air currents around a curtain and reduce the difference in pressures on the two faces of the curtain. Moreover, as already recited, drying at the edges of the coating liquid on the die or other curtain or jet formation means when the solvent is volatile is a problem that injection of an unsaturated inert gas exacerbates. So, prior art discourages the injection of unsaturated inert gas near a curtain or jet. The need, therefore, exists for a gravure coating method wherein a curtain or jet wets the gravure cylinder with a coating liquid that is reactive to the atmosphere and wherein the coating liquid is blanketed by an inert gas in a non-disruptive manner.

SUMMARY OF THE INVENTION

The above need is met according to the present invention by providing a method for gravure coating a solution reactive to atmosphere conditions, including the steps of providing a moving web or other receiving surface to be coated by a gravure cylinder, forming a jet or curtain of coating solution to impinge on and wet an engraved surface of the gravure cylinder; forming one or more zones by enveloping the gravure cylinder and jet or curtain of coating solution; and distributing inert gas within one or more zones without disrupting the jet or curtain of coating solution during wetting of the surface of the gravure cylinder.

Another aspect of the present invention provides a gravure coating apparatus, that includes a gravure cylinder having an engraved surface; a means for causing a web to come into contact with the gravure cylinder in order to form a nip; a doctor blade, positioned prior to the nip, for wiping off excess coating liquid from the engraved surface of the gravure cylinder. A jet or curtain formation means is included to form a jet or curtain of the coating solution such that the coating solution impinges on and wets the engraved surface of the gravure cylinder. A shroud encloses the gravure cylinder and the jet or curtain formation means while providing a gap between the shroud and the web, and includes at least one drainage port. One or more zones form an enclosed region for receiving an inert gas, wherein the jet or curtain stably operates within at least one zone having the inert gas; and a gas supply for distributing the inert gas within the one or more zones.

Briefly stated, the foregoing and numerous other features and advantages of the present invention will become readily apparent upon a review of the detailed description, claims and drawings set forth herein.

DETAILED DESCRIPTION OF THE INVENTION

The present invention includes a means for introducing inert gas to a gravure coating apparatus supplied by a curtain or jet feed that utilizes the natural flow patterns arising from the moving web and rotating gravure cylinder. The gravure cylinder and the curtain or jet feed means are shrouded by a solid wall and the web except for small gaps between the wall and the web and between the wall and the ends of the gravure cylinder. In one embodiment, a baffle and the doctor blade divide the enclosed region into three zones. A first zone contains the jet or curtain formation means and that portion of the gravure cylinder between the nip and the baffle. A second zone contains that portion of the gravure cylinder between the baffle and the doctor blade. A third zone encloses the wiped portion of the gravure cylinder between the doctor blade and the nip. Inert gas supplied to each zone through a fine screen or perforated or porous plate vents out the gaps between the shroud and the gravure cylinder and between the shroud and the web. The doctor blade holder may or may not utilize the deflector plate disclosed in U.S. Pat. Nos. 6,582,515 and 6,558,466 to direct the rejected liquid with little or no splashing or spraying.

In the following description, one embodiment of the present invention may or can be described as a software program. Those skilled in the art will readily recognize that the equivalent of such software may also be constructed in hardware. Because control algorithms and systems are well known, the present description will be directed in particular to algorithms and systems forming part of, or cooperating more directly with, the method in accordance with the present invention. Other aspects of such algorithms and systems, and hardware and/or software for producing and otherwise processing the control signals involved therewith, not specifically shown or described herein may be selected from such systems, algorithms, components, and elements known in the art. Given the description as set forth in the following specification, all software implementation thereof is conventional and within the ordinary skill in such arts.

The computer program may be stored in a computer readable storage medium, which may comprise, for example; magnetic storage media such as a magnetic disk (such as a floppy disk) or magnetic tape; optical storage media such as an optical disc, optical tape, or machine readable bar code; solid state electronic storage devices such as random access memory (RAM), or read only memory (ROM); or any other physical device or medium employed to store a computer program. The present invention can be performed on any well-known computer system, such as a personal computer, workstation, laptop, or other mobile computing devices.

Figure 1:
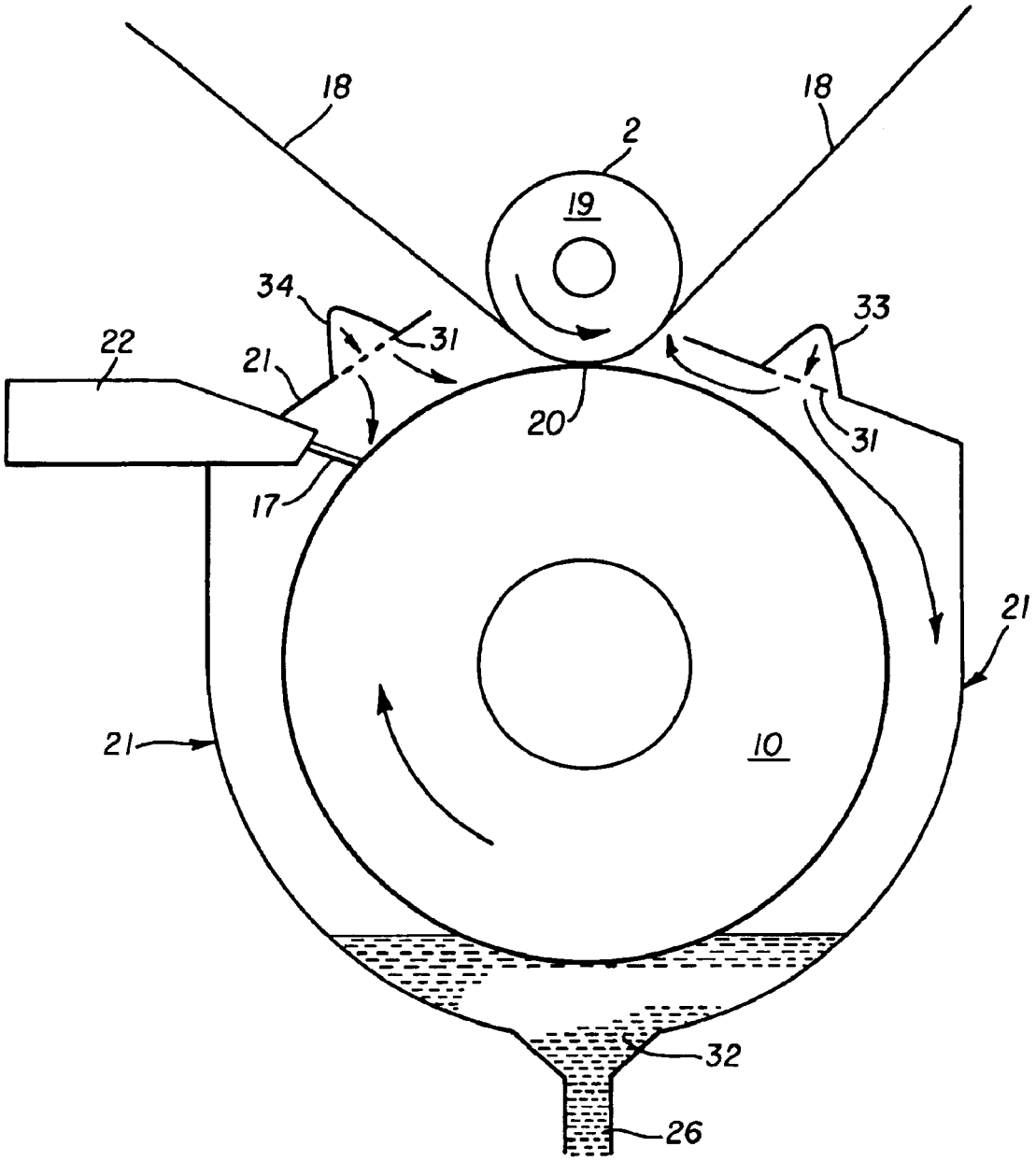
FIG. 1 (Prior Art)
FIG. 1 shows the cross section of a prior art gravure apparatus having a pan feed supplied with an inert gas.

FIG. 1 shows the cross section of a prior art gravure apparatus having a pan feed supplied with an inert gas. Gravure cylinder 10 rotates into a pool of the coating liquid 32. The level of the pool is such that wetting contact with the gravure cylinder 10 is maintained. Doctor blade 17 removes excess coating liquid 32 so that only the engraved portions of the circumferential surface of the gravure cylinder 10 hold coating liquid 32. Typically the engraved portions are patches extending only partially around the circumference of the gravure cylinder 10. Impression roller 19 having an elastomeric cover 2 presses web 18 against gravure cylinder 10 to form nip 20. Within nip 20, a portion of the coating liquid 32 in the engraving is transferred to web 18 to form a coating. The gravure cylinder 10 is enclosed by shroud 21 that also serves as a pan for pool 32 and by a portion of web 18. Inert gas is introduced between the shroud 21 and the gravure cylinder 10 by a first gas distribution means 33 and a second gas distribution means 34. The second gas distribution means 34 also serves to dry any residual film of coating liquid 32 on any portions of the circumferential surface of the gravure cylinder 10 that are not engraved. Coating liquid 32 exits via drainage part 26. Both first gas distribution means 33 and second gas distribution means 34 include a porous or perforated wall 31 for allowing the inert gas passage into shroud 21.

Figure 2:
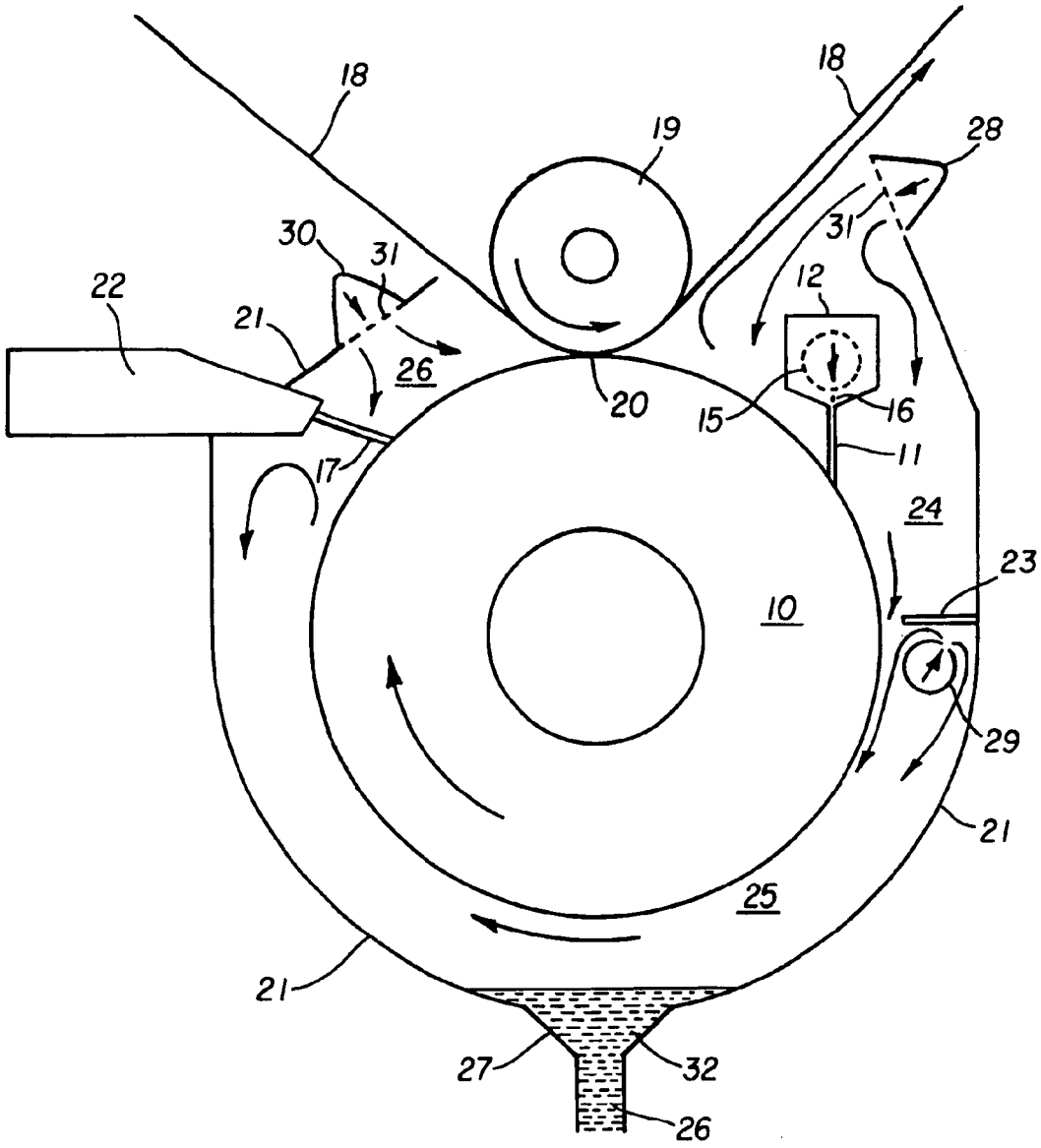
FIG. 2 shows the cross section of a gravure apparatus according to a preferred embodiment of the invention having a jet feed supplied with an inert gas.

FIG. 2 shows the cross section of a gravure apparatus having a jet feed supplied with an inert gas according to one embodiment of the invention. Gravure cylinder 10, doctor blade 17, web 18, impression roller 19, nip 20, doctor blade holder 22, and drainage port 26 are depicted the same as in FIG. 1. The pool of coating liquid 32 is not maintained in wetting contact with the gravure cylinder 10. Instead, the gravure cylinder 10 is wetted by a jet 11 of coating liquid 32 flowing from extrusion die 12 through die slit 16. Coating liquid 11 is distributed uniformly across the width of the web 18 by die cavity 15. Coating liquid 32 circulates from drainage port 26 to die 12 through a conventional coating liquid supply means that is not shown. Shroud 21 and a portion of web 18 enclose the gravure cylinder 10 and jet 11. Nip 20, partitioning baffle 23 and doctor blade 17 divide the enclosed region into a first zone 24, a second zone 25, and a third zone 27. Inert gas is introduced into first zone 24 by first zone gas distribution means 28 that utilizes a conduit with a porous or perforated supply wall 31 from which the inert gas issues. Inert gas is also introduced into second zone 25 by second zone gas distribution means 29, herein a conduit with small holes spaced along its length from which the inert gas issues. Inert gas is additionally introduced into third zone 26 by third zone gas distribution means 30, also forming a conduit with porous or perforated supply wall 31 from which the inert gas issues. The third zone gas distribution means 30 also serves to dry any residual film of coating liquid 32 on any portion of portions of the circumferential surface of the gravure cylinder 10 that are not engraved. Thus, FIG. 2 shows a gravure apparatus for a coating liquid 32 that is reactive with the atmosphere. Coating liquid 32 is supplied to the surface of gravure cylinder 10 by jet 11, a thin, rapidly moving sheet of coating liquid 32, issuing from extrusion die 12.

Figure 3:
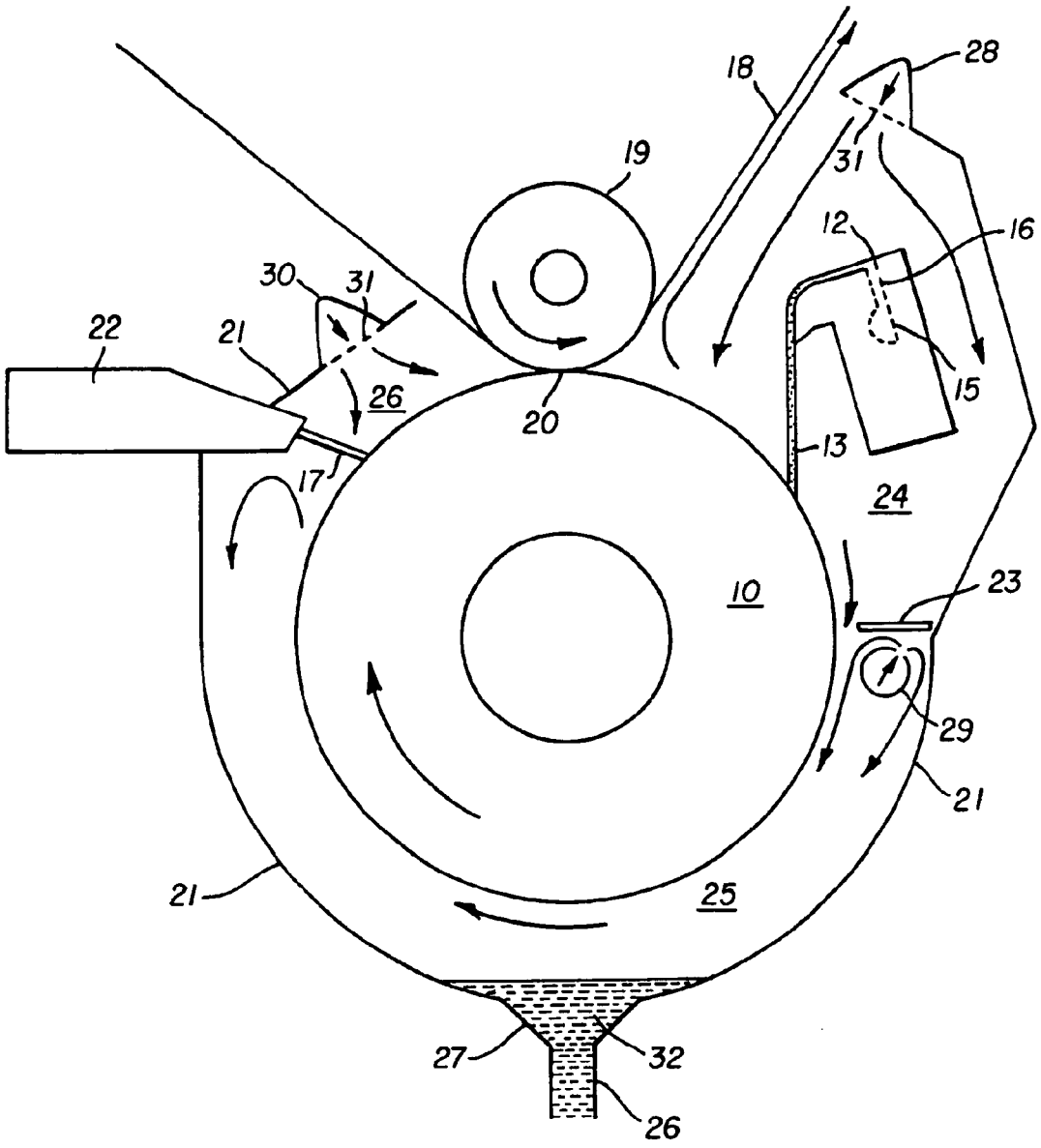
FIG. 3 shows the cross section of a gravure apparatus according to another embodiment of the invention having a curtain feed from a slide die supplied with an inert gas.

FIG. 3 shows the cross section of a gravure apparatus according to another embodiment of the invention having a curtain feed with an inert gas. Gravure cylinder 10, doctor blade 17, web 18, impression roller 19, nip 20, doctor blade holder 22, and drainage port 26 are depicted the same as in FIG. 1. A pool of coating liquid 32 is not maintained in wetting contact with the gravure cylinder 10. Instead, the gravure cylinder 10 is wetted by a curtain 13 of coating liquid 32, formed by extrusion die 14 through die slit 16. In some applications, extrusion die 12 may be substituted with a slide die. The coating liquid 32 is distributed uniformly across the width of the web 18 by die cavity 15. Liquid coating 32 circulates from drainage port 26 to extrusion die 12 through a conventional coating liquid supply means that is not shown. Shroud 21 and a portion of web 18 enclose the gravure cylinder 10 and curtain 13. Nip 20, partitioning baffle 23 and doctor blade 17 divide the enclosed region into first zone 24, second zone 25, and third zone 27. Inert gas is introduced into first zone 24 by first zone gas distribution means 28—a conduit with a porous or perforated supply wall 31 from which the inert gas issues. Inert gas is also introduced into second zone 25 by second zone gas distribution means 29—a conduit with small holes spaced along its length from which the inert gas issues. Inert gas is additionally introduced into third zone 26 by third zone gas distribution means 30—a conduit with porous or perforated supply wall 31 from which the inert gas issues. The third zone gas distribution means 30 also serves to dry any residual film of coating liquid on any portions of the circumferential surface of the gravure cylinder that are not engraved.

Means for forming jets and freely falling liquid curtains are well known in the art and include dies as disclosed in U.S. Pat. Nos. 3,508,947 and 3,632,374 and weirs as in U.S. Pat. Nos. 5,681,389, 5,885,660 and 6,228,431. For delivery of a coating liquid that is reactive with the atmosphere, a jet from an extrusion die is preferable over a curtain. As such, herein an extrusion die 12 comprises at least one cavity 15 and a narrow slit 16 issuing a uniform jet 11 of coating liquid 32. The extrusion die 12 is supplied with pressurized coating liquid 32 by a pump or other supply means to produce a jet 11, i.e., a rapidly moving sheet of coating liquid 32, that impinges on the gravure cylinder 10 and completely fills the engraving at high coating speeds. The narrower the die slit 16, the faster the issuing speed of the jet 11 at a specified rate of flow. Slit heights in the range of 100 to 300 microns are effective, and a slit height in the range of 150 to 200 microns is preferred as small enough to produce high speed and large enough that its obstruction by incidental debris is unlikely when cleaning and filtering methods known in the art are employed. The liquid is completely enclosed by the die, and the length of the jet can be short, on the order of one centimeter. The gravure cylinder 10 is thereby wetted with a minimum of gas/liquid interfacial area where any reactive components of the ambient gas contact the liquid and where solvent loss takes place by evaporation. In contrast, a freely falling curtain 13 produced by a weir as in U.S. Pat. No. 5,885,660 or slide die as in U.S. Pat. No. 3,632,374 must be several centimeters in height to create the same impingement speed. The larger interfacial area corresponding to a tall curtain and the gas/liquid interface on a slide or weir increases reaction and evaporation rates. In any case, however, the amount of coating liquid 32 supplied to the gravure cylinder 10 is controlled such that a supply far in excess of that required to fill the engraving is avoided. Thus, spraying and splashing by the doctor blade 17 as it rejects the excess liquid is minimized. The web 18 is brought into contact with the gravure cylinder 10 by impression roller 19 having an elastomeric cover. The impression roller 19 is pressed onto the gravure cylinder to form a small area of contact with the web in nip 20. A precise amount of coating liquid 32 is transferred to the web 18 from the engraved areas of the gravure cylinder 10 as it separates.

A shroud 21 and the web 18 enclose the extrusion die 12 and gravure cylinder 10. Small gaps of less than about 1 centimeter are provided between the shroud 21 and the web 18, the shroud 21 and the ends of the gravure cylinder 10, and the shroud 21 and the doctor blade holder 22. Preferably, the gap between the shroud 21 and the doctor blade holder 22 is less than about 1 mm. The main body of the shroud 21 is far enough from the surface of the gravure cylinder 10, 2 centimeters or more, that draining liquid does not bridge the distance between the shroud 21 and gravure cylinder 10. The enclosed region is divided into zones by doctor blade 17 and optionally by one or more partitioning baffles 23 extending from the shroud 21 to within about 1 centimeter of the gravure cylinder 10. In one embodiment, the gravure apparatus comprises one partitioning baffle and three zones. First zone 24 encloses the extrusion die 12 and the portion of the gravure cylinder 10 between the nip 20 and baffle 23. Second zone 25 encloses the portion of the gravure cylinder 10 between the baffle 23 and the doctor blade 17 and its holder 22. Liquid rejected by the doctor blade 17 exits the second zone through a drainage port 26 in the bottom of the shroud 21 and is recycled through liquid supply, solvent replenishment, and liquid pumping means. Third zone 27 encloses the remaining, wiped portion of the gravure cylinder between the doctor blade 17 and the nip 20.

A gas that is not reactive with the coating liquid 32 is supplied to each zone. Various distribution means known in the art can be used to distribute the gas. A simple known distributor is a conduit with small holes or slits, about 1 millimeter or less across at the smallest dimension. Such a distributor is difficult to plug and is suitable for supplying the second zone 25 of the enclosure as shown by gas distribution means 29 in FIG. 2. The total cross-sectional area of the holes or slits is small, however, and so the velocity of the issuing gas is high, turbulent, and non-uniform across the width of the coating. Such a distributor is less suited for the first zone containing the jet or curtain. The preferred distribution means for the first zone is a conduit with an outlet wall 31 consisting of one or more screens, meshes, perforated plates, or porous plates in series. A porous plate is particularly preferred, because it provides resistance to flow that evenly distributes the gas along the length of the conduit and maintains laminar flow. The porosity and area of the plates are selected to supply the required flow rate of gas without creating disturbances intense enough to deflect or disrupt the jet or curtain.

The gas distribution means for the first zone 24 is preferably located where the shroud 21 is gapped from the web 18 as shown in FIG. 2. The web 18 entrains gas, starting at the nip 20, and conveys it through this gap. There is as a result a tendency for a counter flow of air to occur in this gap to replace the gas conveyed out by the web. First zone gas distribution means 28 proximate the gap reduces or eliminates this counter flow by replacing the gas conveyed away. In like manner, the surface of the gravure cylinder in the first zone entrains gas and conveys it through the gap between the partitioning baffle 23 and gravure cylinder 10. Gas distribution means 28 also supplies gas to replace that conveyed from the first zone to the second zone by the surface of the gravure cylinder. If the supply by first zone gas distribution means 28 is insufficient, air from outside the shroud is drawn into the first zone to replace the gas conveyed out by the web and gravure cylinder 10. In that event, the coating liquid 32 within the first zone 24 reacts with the air.

The surface of the gravure cylinder 10 in the second zone 25 also entrains gas and drives it through openings between the shroud and the gravure cylinder. Gas is conveyed from the partitioning baffle 23 to the blade 17 and blade holder 22. If there is a gap between the shroud 21 and the doctor blade holder 22, a large volume of gas is conveyed out and must be replenished. In another embodiment of the invention, there is little or no gap between the shroud 21 and the doctor blade holder 22. In such a case, little or no gas escapes the second zone 25 at the doctor blade holder 22, and a flow of gas arises adjacent to the shroud 21 in the direction counter to the motion of the gravure cylinder 10. Some portion of the gas circulates in the second zone 25 and reduces what must be supplied. In contrast, it is difficult to seal the second zone 25 at the ends of the gravure cylinder 10, and air tends to be conveyed in where the ends of the gravure cylinder 10 rotate into the second zone 25. In addition, it is undesirable for the second zone 25 to draw gas from the first zone 24 through the gap between the baffle 23 and the gravure cylinder 10 and thereby increase the rate gas must be supplied to the first zone 24. In a third embodiment of the invention, the second zone gas distribution means 29 is proximate partitioning baffle 23. Gas is supplied to the second zone gas distribution means 29 at a rate such that little or no gas is drawn into the second zone 25 at the partitioning baffle 23 and little or no air is conveyed into the second zone 25 at the ends of the gravure cylinder 10. Preferably, the supplied gas is directed toward the shroud 21 and partitioning baffle 23 as shown in FIG. 2.

The web and surface of the gravure cylinder 10 in the third zone 27 conveys gas to the nip 20. The third zone gas distribution means 30 supplies the gas that is entrained by the surface of the gravure cylinder 10. The rate of supply can also be adjusted to dry the non-engraved portion of the wiped surface of the gravure cylinder 10. The doctor blade 17 may leave a residual liquid film on the non-engraved surface that wets patches of the incoming web intended to remain dry. In worst cases, the functionality of the ribbon is compromised in these areas. By drying the residual film, undesired wetting of the web is reduced or eliminated.

Figure 4:
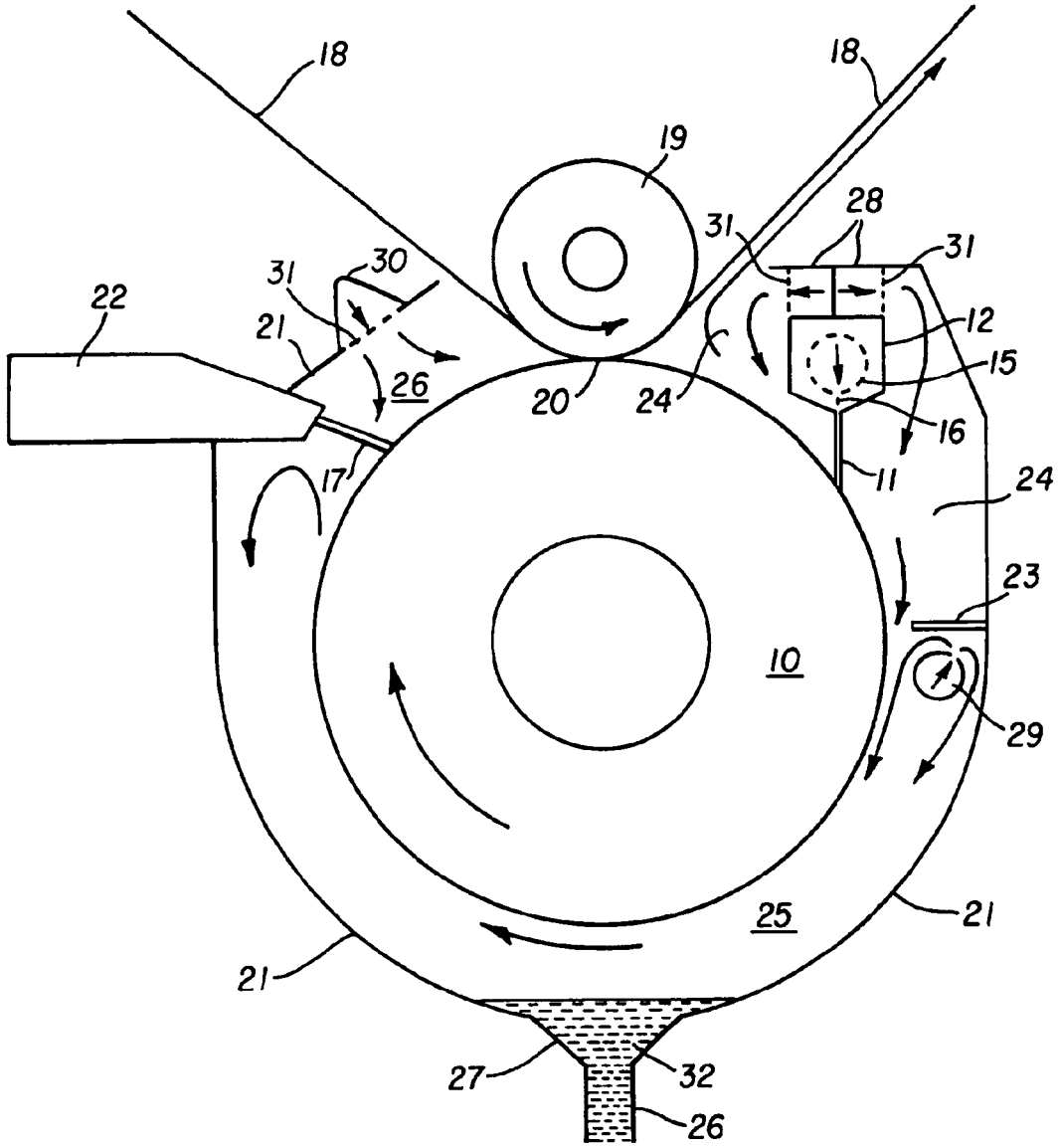
FIG. 4 shows the cross section of a gravure apparatus according to another embodiment of the invention having a jet feed supplied with an inert gas.

FIG. 4 shows the cross section of a gravure apparatus 10 according to another embodiment of the invention having a jet feed 11 supplied with an inert gas. Gravure cylinder 10, doctor blade 17, web 18, impression roller 19, nip 20, doctor blade holder 22, and drainage port 26 are depicted the same as in FIG. 1. A pool of coating liquid 32 is not maintained in wetting contact with the gravure cylinder. Instead, the gravure cylinder 10 is wetted by jet 11 of coating liquid 32 issuing from extrusion die 12 through die slit 16. The coating liquid 32 is distributed uniformly across the width of the web by die cavity 15. Coating liquid 32 circulates from drain 26 to die 12 through a conventional coating liquid supply means that is not shown. Shroud 21 and a portion of web 18 enclose the gravure cylinder 10 and jet 11. Nip 20, partitioning baffle 23 and doctor blade 17 divide the enclosed region into a first zone 24, a second zone 25, and a third zone 27. Inert gas is introduced into first zone 24 by first zone gas distribution means 28 comprising two independent conduits each with a porous or perforated supply wall 31 from which the inert gas issues. Inert gas is also introduced into second zone 25 by second zone gas distribution means 29, i.e., a conduit with small holes spaced along its length from which the inert gas issues. Inert gas is additionally introduced into third zone 26 by third zone gas distribution means 30, i.e., a conduit with porous or perforated supply wall 31 from which the inert gas issues. The third zone gas distribution means 30 also serves to dry any residual film of coating liquid on any portions of portion of the circumferential surface of the gravure cylinder that are not engraved.

Other arrangements for the first zone gas supply can be effective. One such arrangement is shown in FIG. 4. In this case, the first zone gas distribution means 28 is a conduit with two perforated or porous supply walls 31. One supply wall is directed towards the nip 20, and the other supply wall is directed towards the partitioning baffle 23. The supply conduit preferably consists of two parts such that each supply wall is independently supplied with gas to balance the pressures on the faces of the jet 11. This embodiment is, however, more complex than the other embodiments. In the more open arrangement of the one embodiment, little pressure difference develops across the jet 11.

There are many ways to adjust the gas supply rates. A first way is to estimate the flow rates occurring within the shroud as the result of the moving surfaces of the web and the gravure cylinder. Formulas suitable for this purpose are supplied in articles by B. C. Sakiadis, "Boundary-Layer Behavior on Continuous Solid Surfaces: I. The Boundary-Layer Equations for Two-Dimensional and Axisymmetric Flow," AIChE J., 7 (1), 1961, pp. 26–28, and "Boundary-Layer Behavior on Continuous Solid Surfaces: II. The Boundary Layer on a Continuous Flat Surface," AIChE J. 7 (2), 1961, pp. 221–225. A second way is flow visualization. A visible tracer, such as an aerosol, is released into the air near the gaps at the edges of the shroud, and the gas supplies are adjusted until there is no location where the tracer is drawn into the shroud. A third method is to monitor the reaction occurring in the coating liquid, for example, the degree of hydrolysis of titanium alkoxide, and to adjust the gas supplies until an acceptable reaction rate is achieved. A fourth method is to withdraw gas samples from the zones through sampling ports and measure the concentration of oxygen. When the gas supply rates are properly adjusted, little or no oxygen will be detected. Methods of adjusting the gas supply rates can also be employed in automated control schemes. For instance, the gas supply to a zone can be adjusted by a control means based on continuous monitoring of the oxygen concentration in that zone. Of course, some benefit is derived even when the gas supply rates are not optimized.

The gas supplied to the shroud is non-reactive with the coating solution. In the case where the solute is titanium alkoxide, the gas must not contain water vapor. Reactivity includes combustion of the solvent and its vapor, and so the gas preferably does not contain oxygen. Nitrogen gas is usually suitable and is readily obtained. However, other non-reactive gases and gas mixtures can be employed.

As recited above, solvent lost to evaporation must be replenished to maintain a substantially constant concentration of solute. Generally, the higher the gas supply rate, the greater the evaporative losses. A higher gas supply rate directly increases cost. Therefore, gas supply rates exceeding those required to control the reaction rate are undesirable, and shroud geometries that minimize the rate of loss of gas from the shroud are preferred. The inert gas can be saturated with the solvent as supplied, but this step expends solvent as well and requires additional equipment.

Figure 5:
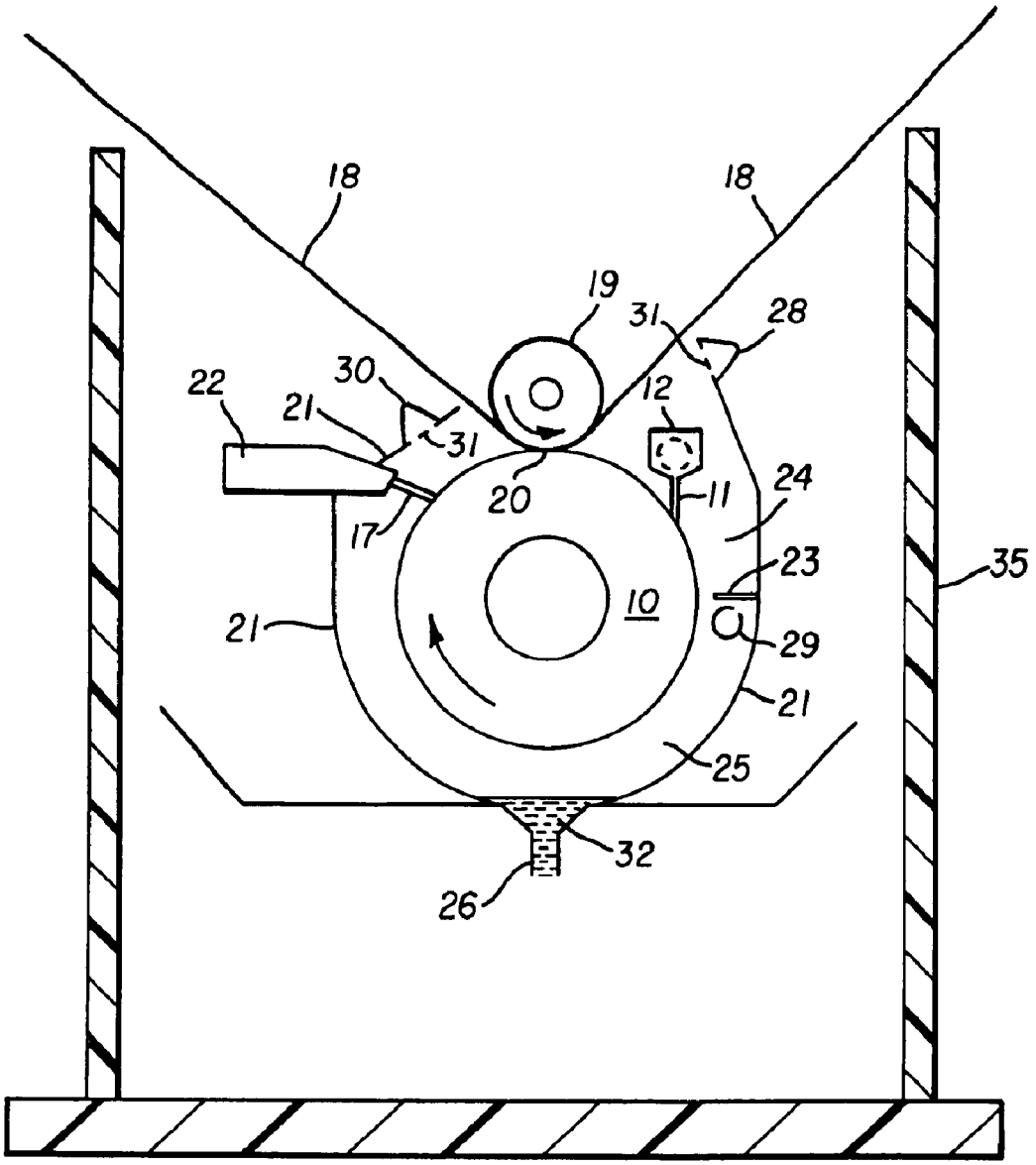
FIG. 5 is a cross-sectional view from the side of a gravure apparatus according to a particularly preferred embodiment of the invention having a jet feed blanketed with an inert gas and an enclosure comprising solid doors and walls.

FIG. 5 is a cross-sectional view from the side of a gravure apparatus according to a single embodiment of the invention having a jet feed blanketed with an inert gas and an enclosure comprising solid doors and walls. Gravure cylinder 10, doctor blade 17, web 18, impression roller 19, nip 20, doctor blade holder 22, and drainage port 26 are depicted the same as in FIG. 1. A pool coating liquid 32 is not maintained in wetting contact with the gravure cylinder 10. Instead, the gravure cylinder is wetted by jet 11 of coating liquid 32 issuing from extrusion die 12. Coating liquid 32 circulates from drain 26 to extrusion die 12 through a conventional coating liquid supply means that is not shown. Shroud 21 and a portion of web 18 enclose the gravure cylinder 10 and jet 11. Nip 20, partitioning baffle 23 and doctor blade 17 divide the enclosed region into first zone 24, second zone 25, and third zone 26. Inert gas is introduced into first zone 24 by first zone gas distribution means 28, a conduit with a porous or perforated supply wall 31 from which the inert gas issues. Inert gas is also introduced into second zone 25 by second zone gas distribution means 29, a conduit with small holes spaced along its length from which the inert gas issues. Inert gas is additionally introduced into third zone 26 by third zone gas distribution means 30, a conduit with porous or perforated supply wall 31 from which the inert gas issues. The third zone gas distribution means 30 also serves to dry any residual film of coating liquid 32 on any portions of the circumferential surface of the gravure cylinder that are not engraved. The entire gravure apparatus is contained within an enclosure 35 consisting of doors and walls.

In another embodiment of the invention, the gravure coating apparatus shown in FIG. 2 is enclosed as shown in FIG. 5. The enclosure 35 may comprise the web 18, the coater side frames, and sliding or swinging doors. An enclosure 35 reduces the penetration of air currents into the zones and provides more reproducible flow patterns. Enclosure 35 is particularly beneficial when coating is interrupted and the impression roller 19 is raised so that a gap with the gravure cylinder 10 is created. Reaction and evaporation rates are reduced by the enclosure 35.

Although three zones with independent gas distribution means are preferred, a reduction in reaction rate can be achieved using a different number and combination of zones and gas supplies.

Figure 6:
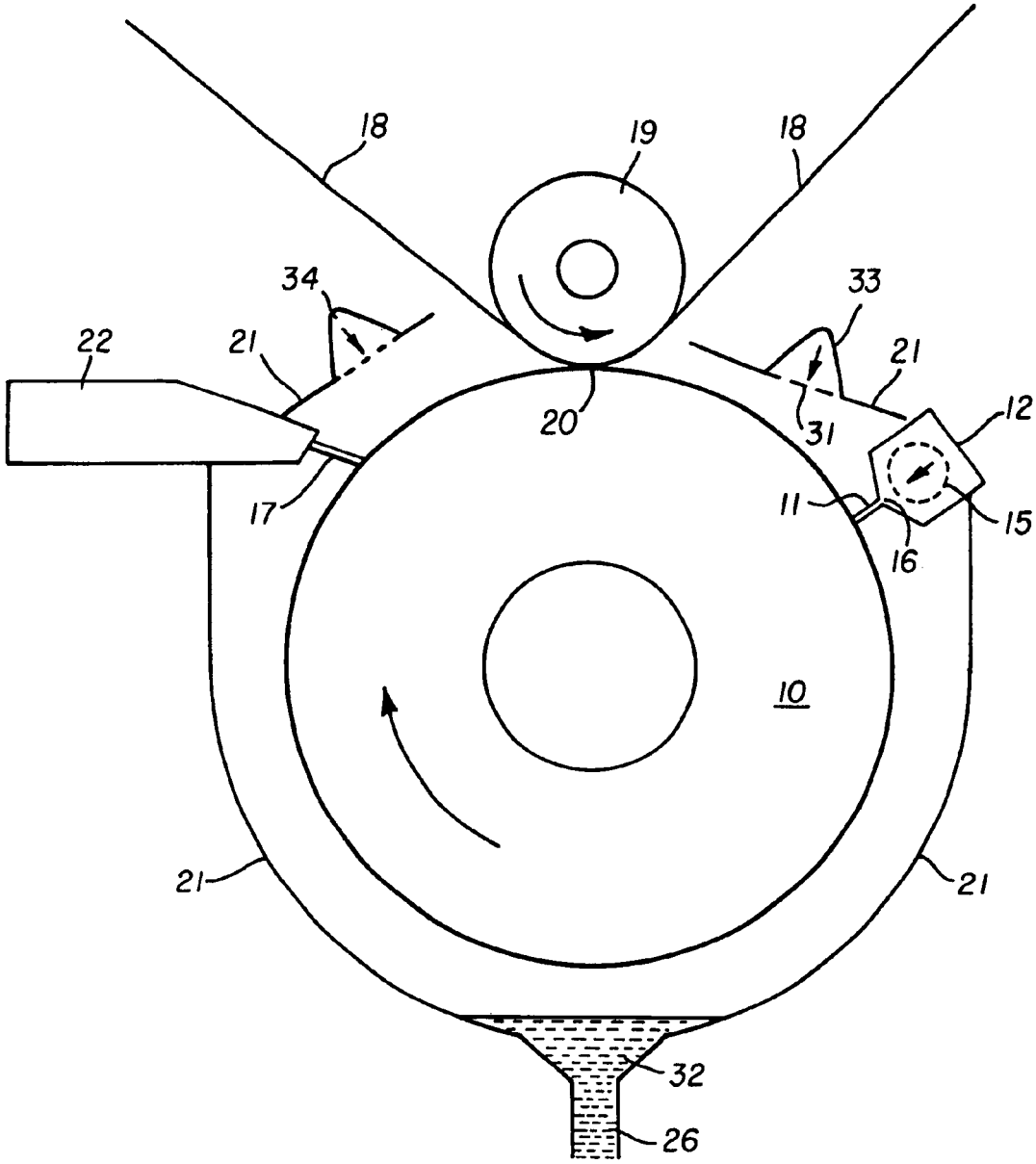
FIG. 6 shows the cross section of a prior art gravure apparatus supplied with an inert gas to which a die for a jet feed has been adapted.

FIG. 6 shows the cross section of a prior art gravure apparatus supplied with an inert gas as shown in FIG. 1 to which a die for a jet feed has been adapted. Gravure cylinder 10 is wetted by jet 11 of coating liquid 32 issuing from extrusion die 12 through die slit 16. The coating liquid 32 is distributed uniformly across the width of the web by die cavity 15. A pool of coating liquid 32 is not maintained in wetting contact with the gravure cylinder 10. Doctor blade 17 removes excess coating liquid 32 so that only the engraved portions of the circumferential surface of the gravure cylinder 10 hold liquid coating 32. Typically the engraved portions are patches extending only partially around the circumference of the gravure cylinder 10. Impression roller 19 having an elastomeric cover presses web 18 against gravure cylinder 10 to form nip 20. Within nip 20, a portion of the coating liquid 32 in the engraving is transferred to web 18 to form a coating. The gravure cylinder 10 is enclosed by shroud 21. Inert gas is introduced between the shroud 21 and the gravure cylinder 10 by a first gas distribution means 33 and a second gas distribution means 34. The second gas distribution means 34 also serves to dry any residual film of coating liquid on any portions of the circumferential surface of the gravure cylinder 10 that are not engraved.

EXAMPLE 1

Gravure coating trials for application of a subbing layer were conducted with DuPont™ Tyzor® TBT as the solute and n-propylacetate as the solvent. An attempt was made to combine a jet feed with the existing shroud for a pan feed, as shown in FIG. 6. For comparison, a second coating station with pan feed for the reverse side of the web was unaltered. The gravure cylinder was 70 inches in width and 48 inches in circumference, and the coating speed was 350 cm/sec. The flow rate of the jet was 5 cc/sec/cm. After 90 minutes, the extent of the reaction at the second coating station was measured to be about 20%. If no nitrogen is supplied, the extent of reaction rises to over 90% in that time. At the first coating station, the flow of nitrogen gas from the first zone gas delivery means was limited to 5 SCFM (0.14 cubic meters/min at standard conditions) or the gas ruptured the jet. At this highest rate, the extent of reaction after 90 minutes was measured to be about 70%, less than with no gas supplied but far above the prior art pan feed. A manufacturing run is terminated when the extent of reaction reaches about 30%, and so the combination of the jet feed with an existing shroud for pan feed gave unacceptable results.

EXAMPLE 2

Nitrogen was supplied according to the preferred embodiment of the invention shown in FIG. 2. Rates of supply were determined by flow visualization and by measurement of oxygen level drawn from center and end sampling ports in the shroud just below the second zone gas distribution means. By delivering 20–25 SCFM (0.57–0.71 cubic meters/min) of nitrogen gas to the first supply and 3–5 SCFM (0.085–0.14 cubic meters/min) to the second supply, the reaction rate at the unaltered second coating station was matched with no significant disruption of the jet. The comparable reaction rate was maintained for a 24-hour manufacturing trial. The replenishment rate for the solvent was higher than that for the pan feed but still acceptable. As previously recited, evaporative losses and reaction rate can be reduced by choice of solvent.

The sequence of events for coating startup and the introduction of the inert gas is not crucial to the invention. With the impression roller disengaged and the gravure cylinder rotating at idle speed, the doors to the enclosure are closed and the gas supplies are turned on at the predetermined rates. The doctor blade is engaged and the flow of coating liquid is started at a rate such that the jet or curtain forms spontaneously. If necessary, the flow rate is then adjusted to the desired feed rate. The web and gravure cylinder are then brought to speed and the impression roller is engaged. If coating is stopped for any reason and the impression roller disengaged, the flow of coating liquid is maintained and the gravure cylinder is brought to idle speed. The gas supplies are left on, and the doors to the enclosure are kept shut. The gas flow rates when coating is stopped can differ from those when coating and can be advantageously determined by one of the methods previously recited.

Those skilled in the art understand that performance can be optimized for specific applications by varying the geometry and operating conditions. Optimization is a matter of experience and routine experimentation.

From the foregoing, it is evident that this invention is one well adapted to obtain all of the ends and objects set forth together with other advantages that are apparent and that are inherent to the method and apparatus.

It will be understood that certain features and combinations are of utility and may be employed with reference to other features and combinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST

10 gravure cylinder
11 jet
12 extrusion die
13 curtain
15 die cavity
16 die slit
17 doctor blade
18 web
19 impression roller
20 nip
21 shroud
22 doctor blade holder
23 partitioning baffle
24 first zone
25 second zone
26 drainage port
27 third zone
28 first zone gas distribution means
29 second zone gas distribution means
30 third zone gas distribution means
31 porous or perforated wall
32 liquid pool
33 first gas distribution means
34 second gas distribution means
35 enclosure

What is claimed is:

1. A gravure coating apparatus, comprising:

a) a gravure cylinder having an engraved surface;

b) a means for causing a web to come into contact with the gravure cylinder in order to form a nip;

c) a doctor blade, positioned prior to the nip, for wiping off excess coating liquid from the engraved surface of the gravure cylinder;

d) a jet or curtain formation means to form a jet or curtain of the coating liquid such that the coating liquid impinges on and wets the engraved surface of the gravure cylinder;

e) a shroud that encloses the gravure cylinder and the jet or curtain formation means while providing a gap between the shroud and the web, and includes at least one drainage port;

f) one or more zones in an enclosed region for receiving an inert gas, wherein the jet or curtain stably operates within at least one zone having the inert gas; and g) a gas supply for distributing the inert gas within the one or more zones.

2. The gravure coating apparatus claimed in claim 1, wherein the one or more zones are partitioned with one or more baffles.

3. The gravure coating apparatus claimed in claim 2, wherein a first zone exists between the nip and a baffle.

4. The gravure coating apparatus claimed in claim 2, wherein a second zone exists between a baffle and the doctor blade.

5. The gravure coating apparatus claimed in claim 2, wherein a third zone exists between the doctor blade and the nip.

6. The gravure coating apparatus claimed in claim 1, wherein each of the one or more zones is supplied with the inert gas.

7. The gravure coating apparatus claimed in claim 1, wherein the jet formation means is a die with at least one distribution cavity and at least one slit.

8. The gravure coating apparatus claimed in claim 7, wherein the slit has a height between 100 and 300 microns.

9. The gravure coating apparatus claimed in claim 1, wherein the curtain formation means is a weir or a slide die.

10. The gravure coating apparatus claimed in claim 1, wherein the gap is less than about 1 cm.

11. The gravure coating apparatus claimed in claim 1, wherein the gap between the shroud and the doctor blade means is less than 1 mm.

12. The gravure coating apparatus claimed in claim 1, further comprising:

h) a controller for controlling the inert gas' flow rate within the one or more zones.

13. The gravure coating apparatus claimed in claim 1, wherein the gas supply for distributing the inert gas is a conduit with holes.

14. The gravure coating apparatus claimed in claim 1, wherein the gas supply for distributing the inert gas is a conduit with one or more walls comprising screens or perforated plates in series.

15. The gravure coating apparatus claimed in claim 1, wherein the gas supply for distributing the inert gas is a conduit with one or more walls comprising porous plates in series.

16. The gravure coating apparatus claimed in claim 1, wherein the gas supply for distributing the inert gas is proximate the web.

17. The gravure coating apparatus claimed in claim 1, wherein the gas supply for distributing the inert gas is proximate a baffle.

18. The gravure coating apparatus claimed in claim 1, wherein the doctor blade includes a deflector.

19. The gravure coating apparatus claimed in claim 1, wherein the inert gas is nitrogen.

20. The gravure coating apparatus claimed in claim 1, further comprising solid doors and walls that, together with the web, enclose the gravure cylinder, the jet or curtain formation means, and the shroud.

* * * * *